United States Patent [19]

Phillips

[11] 4,063,595

[45] Dec. 20, 1977

[54] AIR CONDITIONING SYSTEM HAVING SAFETY FEATURES FOR DETERMINING AND FOR ELIMINATING DANGEROUS CONDITIONS IN THE FORM OF FIRE, SMOKE, OR UNUSUALLY HIGH TEMPERATURES

[76] Inventor: Leonard R. Phillips, 6001 Bayou Grande Blvd., St. Petersburg, Fla. 33703

[21] Appl. No.: 775,956

[22] Filed: Mar. 9, 1977

Related U.S. Application Data

[63] Continuation-in-part of Ser. No. 637,373, Dec. 2, 1975, abandoned.

[51] Int. Cl.[2] ..... A62C 35/24; A62C 37/02; F24F 5/00

[52] U.S. Cl. ..... 169/60; 98/39; 169/16; 236/49

[58] Field of Search ..... 169/5, 10, 15, 16, 54, 169/60, 61; 98/32, 38, 39, 108; 62/259, 263; 236/49; 165/50

[56] References Cited

U.S. PATENT DOCUMENTS

| | | | |
|---|---|---|---|
| 1,087,136 | 2/1914 | Nutter et al. | 169/5 |
| 1,229,071 | 6/1917 | Hammond | 169/5 |
| 1,559,070 | 10/1925 | Callahan | 98/39 |
| 2,031,576 | 2/1936 | Saathoff | 62/259 X |
| 2,586,797 | 2/1952 | Dunlop et al. | 169/61 X |
| 2,898,836 | 8/1959 | Lockheed | 98/38 X |
| 3,256,929 | 6/1966 | Carlson | 165/50 X |
| 3,884,133 | 5/1975 | Miller | 236/49 X |
| 3,915,376 | 10/1975 | Attridge, Jr. et al. | 236/49 X |
| 3,918,525 | 11/1975 | Meckler | 169/16 X |
| 3,926,101 | 12/1975 | Moss | 169/60 X |

*Primary Examiner*—John J. Love
*Assistant Examiner*—Andres Kashnikow
*Attorney, Agent, or Firm*—Stefan M. Stein; Robert F. Frijouf

[57] ABSTRACT

An air conditioning system capable of regulating the temperature of incoming air and further comprising safety features relating to the sensing of abnormal conditions within a room or like treated area concerning the detection of fire, smoke or abnormally high temperature conditions. The flow of air from the exterior of the system is directed to the interior of the room or area being conditioned by a fan or like blower element while being conditioned through direct exposure to hot or cold conditioning fluid. Safety features include sensing elements connected to a liquid spray assembly as well as the blower and air intake so as to determine the amount of incoming air pressure as well as regulate the delivery of certain safety liquids such as water, through the spray assembly.

11 Claims, 3 Drawing Figures

AIR CONDITIONING SYSTEM HAVING SAFETY FEATURES FOR DETERMINING AND FOR ELIMINATING DANGEROUS CONDITIONS IN THE FORM OF FIRE, SMOKE, OR UNUSUALLY HIGH TEMPERATURES

CROSS REFERENCE TO RELATED APPLICATIONS

This is a continuation-in-part of application Ser. No. 637,373 filed Dec. 2, 1975, now abandoned.

BACKGROUND OF THE INVENTION

1. Field of the Invention

This invention relates to an air conditioning system having additional safety features controlled by sensing elements for determining dangerous conditions in the form of fire, smoke or unusually high temperatures wherein the safety features are directed to the elimination of damage or the safety of occupants from the abnormal conditions.

2. Description of the Prior Art

Numerous prior art air conditioning facilities are commercially available for the regulation of the temperature and/or humidity as well as other conditions of the air within a given room or area. Generally, such prior art facilities force air from an exterior source, such as atmosphere, to be passed through a given housing and exposed to temperature regulating air conditioning means of numerous varieties which are well known in the art. After temperature regulation and possibly humidity regulation through the exposure of the incoming conditioned air to various liquid sources, the air is directed into the room or given area or space to be conditioned.

The vast majority of such air conditioning systems are designed exclusively for the regulating of the temperature and/or humidity conditions of the incoming air and are not designed to incorporate highly desirable safety features in the case of abnormal conditions such as fire, smoke or unusually high temperatures. A possible exception to this is the incorporation of certain sensing means in prior art devices whereby the air conditioning system will shut down in order to eliminate the incoming feed or flow of exygen to a room being conditioned. The theory of shutting down such a system would be to eliminate a fresh supply of oxygen to a fire in an effort to control the fire by smothering it or removing the required source of combustible oxygen.

Conventionally, fire protection in buildings or any type of enclosed structure was usually accomplished by such safety devices as a conventional sprinkler system wherein sprinklers are mounted on the ceiling of a given room or throughout a building structure. Each of the individual sprinkler heads of the system comprises a heat or smoke sensing element whereby water or an applicable fluid is directed from the sprinkler head upon the sensing of a predetermined heat, fire or smoke within the surrounding atmosphere of the sprinkler head. It has been only relatively recently that the fact has been discovered that most casualties of a fire within a given structure are due to smoke inhalation, etc. Accordingly, recent designs and developments in safety equipment for fires have been concentrating on or directed to the ventilation and air pressure control measures concerned primarily with the control of the spread of smoke created in a given enclosed area or building structure during the fire. It is now accepted that, in order to control such smoke, it is required to maintain a higher air pressure within a given enclosed area thereby creating a refuge within the enclosed area due to the fact that the increased pressure prevents the ingress of smoke to the defined area.

Accordingly, a number of the prior art conditioning systems which have been designed to eliminate or shut down the flow of air intake, are not directed to the prevention or elimination of smoke spreading throughout a given confined area where a fire exists.

Similarly, conventional sprinkler systems now being utilized are designed for the combating of an existing fire or the like through "drowning" a given area in an attempt to put out the fire. Many of the presently existing sprinkler systems are not designed to establish an area of refuge through being utilized in combination with an air pressurized system wherein the spreading of smoke is reduced or eliminated.

Accordingly, there is an obvious need in the industry for an air conditioning facility comprising, in combination, various systems which can economically effect a high degree of personal safety in occupied building perimeter spaces, such as hotels, hospitals, office rooms, or residences. The capabilities of such an air conditioning facility should be not only to regulate the temperature and/or humidity of incoming air for the comfort of the occupants of a given room, but also to create an area of refuge in each room or space in the event a fire or smoke condition exists.

SUMMARY OF THE INVENTION

This invention relates to an air conditioning facility incorporating certain safety features to establish an area of refuge along the perimeter spaces of a room or like confined structure during the existence of a fire, accompanying smoke or abnormally high temperatures resulting from such fire.

More specifically, the air conditioning facility of the present invention comprises an air condition means disposed in fluid communication with incoming air from an air intake. The air conditioning means may be in the form of a fluid containing coil of substantially conventional design disposed in interruptive relation relative to the path or flow of incoming air. The coil itself is disposed in fluid communication with either hot or cold fluid by means of a fluid delivery system wherein hot or cold fluid is regulated to pass through the coil so as to be directly exposed to the incoming air in heat transferring relation thereto.

Fluid directing means in the form of a fan or like forces air from the air intake means through the air conditioning means to the exterior of the housing in which the subject air conditioning assembly is mounted. The air intake means itself comprises a damper structure which may regulate the flow of incoming air from the exterior of the building to the extent that the flow of air may be completely shut off or be positioned to define maximum air flow into the interior of the building or room through the housing of the air conditioning facility and the air conditioning coil itself.

The air conditioning facility comprises a control means including a first sensing element which is electrically or otherwise operatively connected to both the damper included in the air intake means and the fan. Upon the sensing of a predetermined condition such as the existence of smoke within the confined area, the damper is positioned to maximum open orientation and the fan is activated so as to force air to the interior of the room or confined space being conditioned. This serves to pressurize the interior of the room and, because of the overpressurized condition, the elimination or reduction of smoke ingress into the room will be accomplished.

The control means comprises a second element which may be in the form of a temperature sensor operatively connected to a valving assembly which, in turn, controls the flow of liquid to a spray assembly mounted within the housing of the air conditioning facility and disposed to direct the flow of liquid to the exterior thereof. Such exterior direction of liquid can be defined by a pattern which will establish a protected area for refuge of occupants in a confined area or room along the perimeter of such room in the general vicinity of the air conditioning facility itself. The combination of liquid spray and pressurized conditions being directed to the interior of the room thereby provides certain safety features in combination with facilities for regulating the temperature of the air or atmosphere on the interior of a room.

It should be noted that a structural feature of the present invention comprises the existence of a fluid delivery means to the conditioning coil by means of hot and cold water pipes disposed in fluid communication through appropriate valving means wherein either hot or cold water can be supplied to the conditioning coil to regulate the temperature of incoming air. A fluid return means in the form of a single duct or conduit is located downstream and in fluid communication with the coil so as to remove the fluid passing therethrough. The spray means may be connected in fluid communication with either the cold incoming fluid delivery conduit or, alternately, the fluid return conduit serving to exit fluid from the conditioning coil as set forth above.

The air conditioning facility itself is designed for mounting adjacent to a portal, such as a window, of conventional design wherein the fluid delivery system including the hot and cold delivery conduits may be disposed in communication with a plurality of floors in a large building or the like.

This invention accordingly comprises an apparatus possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings in which.

Similar reference characters refer to similar parts throughout the several view of the drawings.

DETAILED DESCRIPTION

Figure 1:
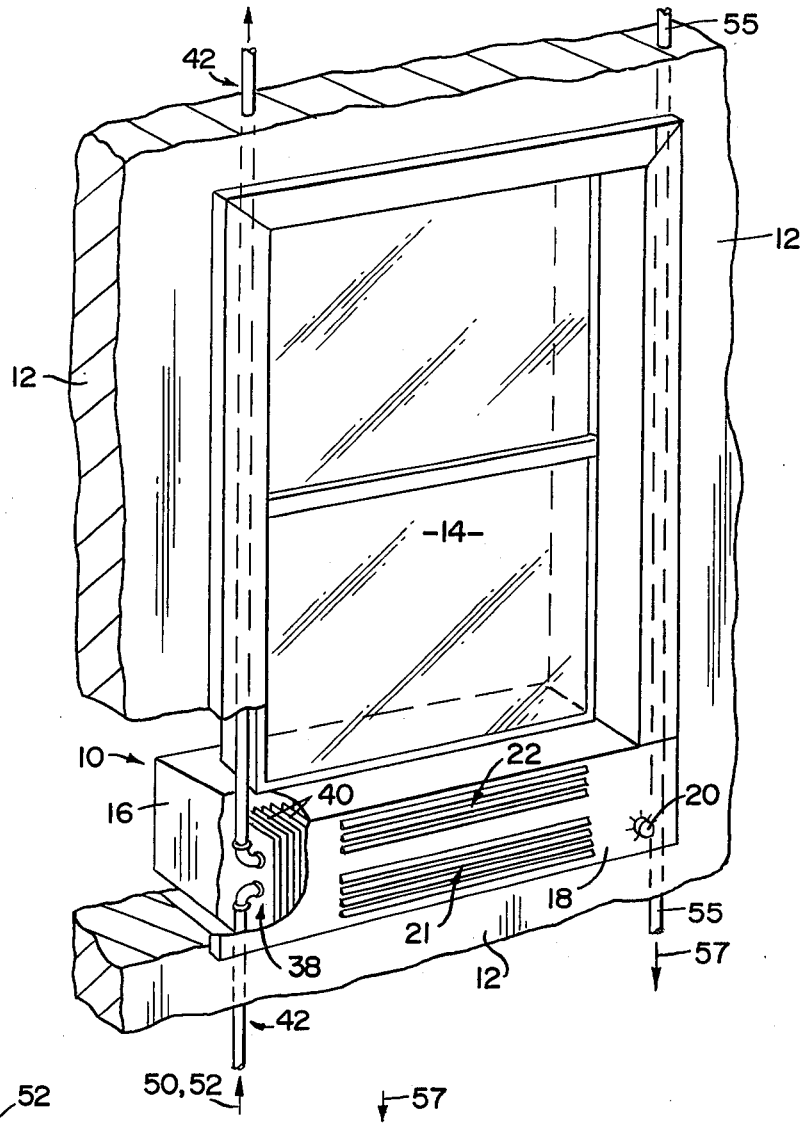
FIG. 1 is a partial cutaway perspective view of the air conditioning facility of the present invention and installed relation to the wall or confined boundaries of a room or building structure.
Figure 2:
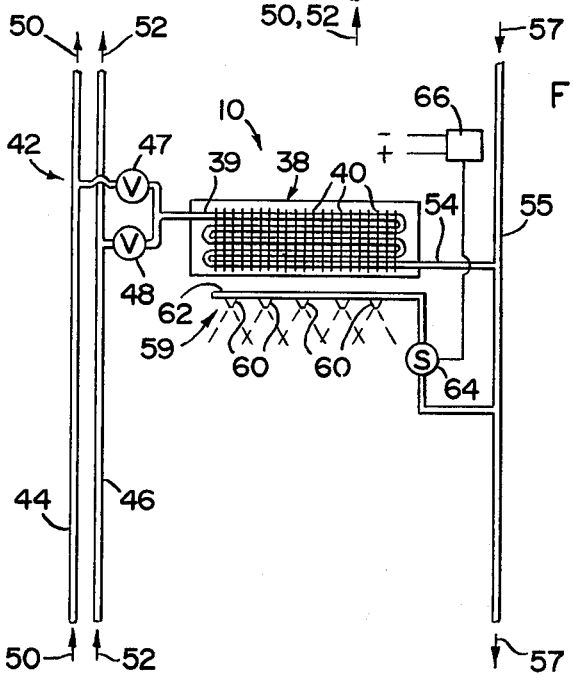
FIG. 2 is a schematic diagram of the structural features of the present invention including fluid flow of the conditioning fluid through the delivery and return means of the present.
Figure 3:
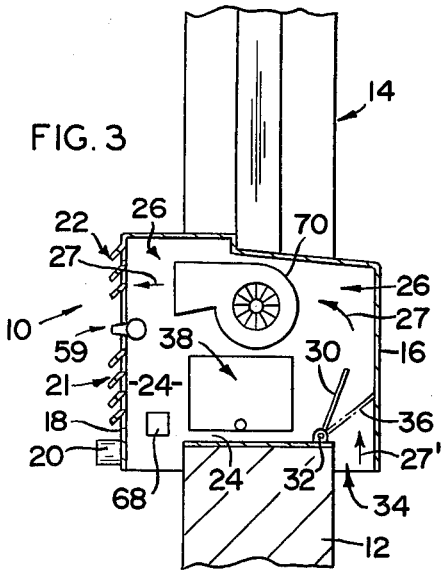
FIG. 3 is a side view showing the interior structural components mounted on a housing and their relation to the interior and exterior of a room or like area to be conditioned.

The air conditioning facility of the present invention is generally indicated as 10 in FIGS. 1, 2 and 3. With relation to FIG. 1, the air conditioning facility 10 is mounted on a wall structure 12 which defines the peripheral boundaries of a room or confined area. A conventional type portal 14, in the form of a window or the like is mounted immediately adjacent to the air conditioning facility 10. It should be noted that the specific wall structure and portal 14 is not, per se, a part of the present invention, but is represented in FIG. 1 as disclosing the means by which the air conditioning facility is mounted relative to a confined area. The facility 10 comprises a housing 16 including a front face panel 18 located on the interior of the room or space to which conditioned air is directed. An operating knob 20 is interconnected to various control means to be described hereinafter. Such control means, in addition to the recitation to follow, could regulate certain thermostat means to control the temperature and other desired conditions of the air entering into the room defined by the boundary walls 12. Panel 18 comprises return air grill 21 and an air delivery grill 22 which, as shown in FIG. 3, is connected in fluid communicating relation to return air duct 24 and air passageway 26, respectively. Air passageway 26 is defined as that portion of housing 16 through which passes the intake air before or after being conditioned. Such passageway or flow path is defined by directional arrows 27 as shown in FIG. 3. Similarly, return passage 24 defines air intake means and the path of travel of air exiting from the interior of the room in normal operation of the air conditioning facility. The returned air is drawn through air passageway 26 by fan 70 to exit from air delivery grill 22.

Referring primarily to FIGS. 2 and 3, the subject air conditioning facility 10 comprises an air intake means including a damper structure 30 movably connected as at 32 in flow regulating relation relative to the air passage entrance 34. More specifically, damper structure 30 can be positioned in closed relationship as indicated in broken lines by numeral 36 whereby flow of incoming air in the direction of arrow 27' is prohibited from the exterior of the housing 16. In the open position indicated in solid lines by numeral 30, air flows along air passage 26 in the direction indicated by arrow 27' and passes through air conditioning means 38 (FIG. 2).

The air conditioning means 38 comprises a coil and fin structure 39 and 40 respectively, whereby the coil is disposed in path interruptive relation to the flow of air passing along air passageway 26 in the direction indicated by directional arrows 27. Fluid delivery means (FIG. 2) is generally indicated as 42 and includes a plurality of fluid conduits including a hot fluid conduit 44 and a cold fluid conduit 46. Valve means 47 and 48 are disposed in fluid regulating relation to the fluid passing through conduits 44 and 46 respectively. As indicated by directional arrows 50 and 52, the flow of either hot or cold fluid passes through the individual hot and cold conduits 44 and 46 and may pass, by virtue of the operative position of valves 47 and 48, through coil 39. The temperature of the incoming air is thereby regulated by heat transfer as the air passes over and around the coil and fin structure 39 and 40. Fluid is passing continuously from either hot or cold conduit 44 and 46 through respective valve means 47 and 48 through coil 39 and out exit conduit 54 to return conduit 55. The flow of direction in return conduit 55 is indicated by directional arrow 57 as shown in FIG. 2. As best represented in FIGS. 1 and 2, the fluid delivery means 42 and the return conduit 55 can extend successively in communicating relation with a plurality of floors in a multi-story of multi-floor dwelling or building. This will allow hot and cold fluid, in the form of water, to pass through and into cooperative relation with a number of air conditioning facilities located in substantially end line relation on corresponding positioned rooms or area on the various floors of a building. This is also in conformance with the conventional building design as is well known in the building industry.

Another feature of the present invention comprises a spray means generally indicated as 59 including a plurality of spray heads 60 disposed in fluid communication with spray condut 62. A solenoid valve 64 is operatively connected to control means in the form of a second sensing element 66 which will be described in greater detail hereinafter.

Fluid directing means 70 in the form of a fan or like forces intake air from return delivery grill 21 or air passage entrance 34 through the air conditioning means 38 to the exterior of the housing 16 in which the subject air conditioning assembly is mounted. Fan 70 may be provided with multiple air speeds for example, four speeds. The first three speeds may be referred to as a low, medium and high speed operation which are utilized during the normal operation of the air conditioning facility. In the low, medium and high speed operation, returning air may be received from the return air grill 21 through return duct 24 to enter air passageway 26 when damper 30 is in the phantom position shown as 36. Alternatively, damper 30 may be established in the position as shown enabling air to enter air passage entrance 34 into air passageway 26. In either case, the incoming air is forced by fan 70 out of the air delivery grill 22. The fourth speed of operation of fan 70 may be referred to as an emergency speed which has a higher fluid velocity than the normal operation speed. This emergency speed will be explained hereinafter.

The control means mentioned above further comprises a first sensing element 68 in the form of a smoke detector shown located in the return air duct 24, but it should be understood that the first sensing element 68 may be located within the interior of the room remote from the facility 10. The smoke detector serves to activate the damper structure 30 and the emeregency speed of fan or fluid directing means 70. More specifically, the smoke detector 68 is mechanically, electrically or operatively connected in some way to regulate both the position of damper structure 30 and the activation of emergency operative speed of fan or fluid directing means 70. Accordingly, when smoke is detected in predetermined quantity coming from a building interior or the like, the damper 30 is placed to its maximum open position and fan 70 is operatively activated into the emergency speed (fourth speed) so as to force air into the interior of the room thereby causing an overpressurized state. As set forth above, this serves to prevent or reduce smoke ingress into the confined area. Similarly, element 66 is electrically, or otherwise operatively connected to a solenoid valve 64 wherein, upon the sensing of a predetermined condition such as in a dangerously increased temperature by element 66, solenoid valve 64 is open. This establishes fluid communication between spray means 59 and more particularly spray head 60, spray conduit 62 and fluid return conduit 55. Accordingly, fluid is directed from conduit 55 through solenoid valve 64 and out the spray head 60 in a predetermined pattern. This predetermined pattern is defined to establish a refuge area in the general vicinity of the air conditioning facility 10 for the purpose of providing a safety area during fire or like undesiravble condition. It should be understood that solenoid valve 64 may be connected in fluid communicating relation with the cold water conduit 46 of the fluid delivery means rather than the fluid return conduit 55 if such is structurally desirable.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention.

Now that the invention has been described:

What is claimed is:

1. An air conditioning system of the type primarily designed to treat air from an external source, said system comprising: a housing, air conditioning means mounted in said housing and disposed in heat conducting relation to incoming air from the external source, a fluid circulating assembly connected in fluid communication with said air conditioning means, air intake and air return means disposed on said housing, said air intake means being disposed in fluid communication with said air conditioning means, control means interconnected to said air intake means, said control means including a first sensing element connected in movement regulating relation to said air intake means, whereby inflow air from the external source is regulated by said control means; and spray means mounted on said housing and disposed to direct fluid to the exterior of said housing and connected in fluid communication with said fluid circulating assembly, whereby fluid from said fluid circulating assembly is directed from said housing by said spray means.

2. An air conditioning system as in claim 1, wherein said fluid circulating assembly comprises a plurality of fluid delivery means, at least a first and a second of said plurality of fluid delivery means connected in fluid communication with said air conditioning means, whereby said air conditioning means receives fluid passing from one of said first or second fluid delivery means.

3. An air conditioning system as in claim 2, wherein said first and second fluid delivery means are connected in fluid communicating relation with hot and cold fluid supply means respectively; fluid return means connected to said air conditioning means, whereby fluid passing from said first or second fluid delivery means through said air conditioning means exits from said system through said fluid return means.

4. An air conditioning system as in claim 3, wherein said air conditioning means comprises a coil element disposed in fluid communication with said first and second fluid delivery means, said coil element disposed to movably position fluid in heat transfer relation with air from said air intake means.

5. An air conditioning system as in claim 1, wherein said control means comprises a second sensing element operatively connected to said spray means, whereby said spray means is activated upon predetermined conditions of said second sensing element.

6. An air conditioning system as in claim 5, wherein said second sensing element comprises a heat detection means disposed in operative relation to said spray means whereby said spray means is actuated to deliver liquid to the exterior of said housing upon predetermined conditions being sensed by said heat detection means.

7. An air conditioning system as in claim 1, wherein said spray means is connected in fluid communicating relation with fluid return means whereby, upon activation, fluid from said fluid return means is forced to the exterior of said housing through said spray means.

8. An air conditioning system as in claim 1, further comprising fluid directing means mounted in said housing in fluid communication with said air conditioning means, whereby fluid from said air conditioning means is directed in predetermined direction, to the exterior of said housing by means of said fluid directing means.

9. An air conditioning system as in claim 8, wherein said fluid directing means comprises a fan assembly disposed in fluid directing relation to the exterior of said housing.

10. An air conditioning system as in claim 8, wherein said first sensing element is operatively connected to said fluid directing means, said first sensing element disposed in activating relation to said fluid directing means, said fluid directing means being in direct fluid flow communication with said air intake means, whereby fluid is forced from said air intake means through said fluid directing means and directed outwardly from the exterior of said housing in a predetermined direction upon activation of said first sensing element based on sensing a predetermined condition.

11. An air conditioning system as in claim 8, wherein said first sensing element comprises smoke detecting means whereby upon the determination of a predetermined amount of smoke in the surrounding atmosphere relative to said smoke detector means, air is forced in a predetermined direction to the exterior of said housing from said air intake means and through said fluid directing means.

* * * * *